United States Patent [19]

Shubin et al.

[11] 4,000,636

[45] Jan. 4, 1977

[54] PIPE BENDING MACHINE

[76] Inventors: Vladimir Nikolaevich Shubin, Pervomaiskaya ulitsa, 1, kv. 103; Viktor Sergeevich Silantiev, Kastanaevskaya ulitsa, 57, korpus 1, kv. 58; Alexandr Sergeevich Khlyntsev, Kolenchataya ulitsa, 4a, kv. 8; Antonina Petrovna Barsova, Sheremetievskaya ulitsa, 67, korpus 2, kv. 5; Galina Alexeevna Rodionova, 5 Parkovaya ulitsa, 40, korpus 1, kv. 65, all of Moscow, U.S.S.R.

[22] Filed: May 1, 1975

[21] Appl. No.: 573,404

[52] U.S. Cl. ..... 72/173; 72/217; 72/251; 198/628; 226/172

[51] Int. Cl.[2] ..... B21D 7/024

[58] Field of Search ..... 72/158, 149, 150, 156, 72/157, 159, 166, 170, 174, 251, 217; 226/172, 187; 198/165

[56] References Cited

UNITED STATES PATENTS

| | | | |
|---|---|---|---|
| 2,033,423 | 3/1936 | Frank | 72/217 |
| 2,569,266 | 9/1951 | Thompson | 72/166 |
| 2,642,280 | 6/1953 | Fisk | 226/172 |
| 3,373,587 | 3/1968 | Shubin et al. | 72/158 |

*Primary Examiner*—Milton S. Mehr
*Attorney, Agent, or Firm*—Lackenbach, Lilling & Siegel

[57] ABSTRACT

A pipe bending machine comprising a bed plate which mounts a bending head, a mechanism for feeding pipes to be treated into the bending head, and a drive. The pipe feeding mechanism consists of two parallel rows of rollers arranged symmetrically in relation to the pipe axis and fitted into cages used commonly by each row. The rollers in each row and the associated cage are embraced by a hauling chain designed for coupling the drive which moves the chain toward the bending head. Placed on the outside on each chain is a closed-loop strip made of elastic friction material. A pipe to be treated is clamped in the gap between the strips and is fed to the bending head when the chains are displaced.

The pipe bending machine of the present invention permits bending the pipes of any shape in space, including parts made of thin-walled and soft metal pipes.

8 Claims, 5 Drawing Figures

PIPE BENDING MACHINE

The present invention relates to metal pressure shaping and, more particularly, to a pipe bending machine wherein pipes are bent by hauling them into a bending head.

This invention is especially well suited for high-rate automatic bending of parts made of thin-walled pipes of any shape in space, and is still of particular advantage for bending of pipes made of soft metals (such as copper, aluminium, etc.) as well as for bending of pipes with polished surfaces and, especially, of pipes subjected to heavy vibration in service, as in the case with flying vehicles.

Widely known in the art are universal pipe bending machines for spatial shaping of pipes, including pipe coils, by hauling the pipes into a bending head.

In the prior-art machines, the pipe is hauled by means of clamping arrangements mounted on a carriage.

The main disadvantage of the abovementioned machines resides in that the operating cycle of the bending machine consists of a plurality of auxiliary operations whereat stops of the bending machine are inevitable. Consequently, the efficiency of said machines is low although the pipe hauling rate is faily high. Thus, unloading-loading, pipe turning and idle travel of the carriage in said machines take over 70 per cent of the total operating cycle time.

Another disadvantage of said machines resides in cumbersome construction, for instance, the length of the bed plate guides depends on the length of the pipe blank to be treated.

Also widely known are pipe bending machines, wherein the above-mentioned disadvantages have been eliminated. They include machines for bending of cylindrical pipe coils.

Said machines comprise a bed plate which mounts a bending head, a mechanism for feeding pipes to be treated into the bending head, and a drive associated with the head and mechanism.

The pipe feeding mechanism includes two parallel rows rollers arranged symmetrically in relation to the axis of the treated pipe and fitted into cages. The cage of one row of rollers is rigidly fixed to the bed plate, whereas the cage of the other row is allowed to turn in the plane normal to the axes of rollers for uniform clamping of the pipe normal to the axes of rollers for uniform clamping of the pipe throughout its length, and is spring-loaded in the direction toward the first cage.

In said machines, the rollers in one row are load-bearing parts, while the rollers in the other row are driving parts.

The cylindrical surfaces of all the rollers are provided with annular radial grooves wherein the pipe to be treated is clamped.

When the driving rollers revolve, the pipe is fed into the bending head by virtue of frictional forces exerted between the surfaces of the pipe and roller annular grooves.

The main disadvantage of said pipe bending machines lies in the fact that the feeding mechanism fails to maintain a constant preset rate of feed because mutual slippage occurs between the contact surfaces of the rollers and pipe.

The slippage is accounted for by the fact that various contact points of the pipe surface and roller annular groove surface lie at different distances from the axis of rotation of the roller, hence, the circumferential speeds of said contact points are not equal, and slippage is inevitable.

In bending of cylindrical pipe coils, the above disadvantage does not affect the accuracy in manufacture of pipe coils since the coil radius and the pitch do not depend upon the rate of feed.

However, in bending of pipes for shaping three-dimensional components different from that of the coils, the rate of feed of pipes into the bending head must be constant, and such components cannot be manufactured by the use of said machines, which greatly limits their range of application.

Besides, high contact stresses in the areas of contact between the rollers and the pipe (resulting from small area of contact) do not permit use of the prior-art machines for bending of thin-walled pipes and soft metal or polished-surface pipes because deformation of the pipe surfacs (scores, dents, etc.) cannot be avoided.

Still another disadvantage resulting from small area of contact between the rollers and the pipe resides in the fact that a large number of rollers must be used in each row, consequently the total length of the whole machine is excessive.

It is an object of the present invention to provide a pipe bending machine, the mechanism thereof for feeding the treated pipe into the bending heat permits a constant rate of feed, which, in turn, allows three-dimensional bending of pipes at a desired accuracy.

Another object of the invention is to provide a pipe bending machine, the mechanism thereof for feeding the treated pipe into the bending head permits clamping of the pipe at minimum contact stresses, and thereby allows the use of said machine for bending of thin-walled, soft metal and polished-surface pipes.

A further object of the invention is to provide a pipe bending machine with comparatively small overall dimensions in comparison with the prior-art machines of the same class.

Still another object of the present invention is to provide a pipe bending machine, the assemblies thereof possess a high strength and endurance.

This and other objects are accomplished by providing a pipe bending machine, the bed plate whereof mounts a bending head; a mechanism for feeding pipes to be treated into the bending head, comprising two rows of rollers arranged symmetrically in relation to the pipe axis and fitted into cages, with the cage of one row of rollers rigidly fixed to the bed plate whereas the cage of the other row of rollers installed on said bed plate is allowed to turn in the plane normal to the roller axes and is spring-loaded in the direction toward the first cage; and a drive of the bending head and feeding mechanism.

According to the invention, the rollers in each row in assembly with the associated cage are embraced with a closed-loop hauling chain, the inner side thereof is suited for coupling of said drive which displaces the chain during operation of the machine toward the bending head, while the outer side of each chain receives a closed-loop strip made of elastic friction material, with the result that the pipe being treated is fed into the gap between the rows of rollers, is clamped by said strips and is fed into the bending head when the chains are displaced.

The mechanism of the present invention used for feeding the pipe into the bending head of the machine prevents slippage of the pipe relative to the rollers because any sections of the contact surface of the pipe, strips and hauling chains are set to progressive motion at equal rates predetermined by the machine drive and constituting the rate of feed of the pipe into the bending head. The rollers in this case serve as clamps only.

Since the rate of feed can be preset and maintained constant, accurate bending of pipes can be effected and complicated three-dimensional articles can be manufactured.

Besides, the use of strips made of flexible material provides for a marked increase in the area of the surfaces of the feeding mechanism contacting the pipe surfaces and, hence, for minimizing the contact stress.

The machine of this invention can be used for machining of thin-walled, soft metal and polished-surface pipes, the surfaces thereof must be protected against damage at shaping.

Decrease of the contact stress also results in an increase in the feeding force, consequently, pipes can be bent at minimum radiuses with the use of mandrels inside the pipes without increasing the number of rollers or using other means for improving cohesion between the pipe and roller surfaces, including such materials as sand, utilized in theabove-mentioned U.S. Pat.

Yet another result of reducing the contact stress is the possibility of cutting down the number of rollers in each row and, hence, minimizing the length of the feeding mechanism and the overall dimensions of the whole machine.

It is expedient that each hauling chain be assembled of individual gear racks, hinged to one another, with the rack teeth directed toward the rollers, and with each chain coupled with the drive by means of a pinion interacting with the teeth of said racks and installed on the cage of the respective row of rollers essentially beside the initial portion of the contact surface between the rollers and chain racks.

The inside gearing between the chain racks and the pinion permits utilizing the wedging force exerted therein for clamping the pipe.

Inasmuch as the driving pinion is positioned beside the initial section of the surface of contact between the gear racks and rollers, the stretching force acting on the hinge joint parts of said gear racks can be eliminated, and the force required for feeding the pipe into the bending head can be translated through the end faces of said racks with the result that wear of the rack hinge joints is minimized and formation of gaps between the hinge joint parts is precluded.

Another feature of the invention is that each gear rack travelling during diplacement of the chain is simultaneously in contact with at least two rollers.

This embodiment of the invention provides for straightness of the chain section in contact with the rollers and thereby improves operation of the gear pair with involute tooth gearing consisting of a gear rack and a pinion.

Besides, the straightness and continuity of said chain section permit obtaining a desired straight support for the strip made of elastic friction material due to which the area of contact between the strip and the treated pipe increases, and wear of the strip is reduced.

A further advantage of the invention is that each gear rack receives lengthwise guides located on both sides of the rack teeth, with the guides serving to establish contact between the rack and the rollers, while annular grooves made in the cylindrical surfaces of the rollers permit passage of the gear rack teeth, with a lengthwise axial recess on the outer side of each rack accommodating the strip.

This embodiment of the invention provides for a reliable support of the chain gear racks resting on the rollers, and for straight dislacement of the racks between the row of rollers because the clamping force acting on the pipe and the wedging force exerted between each gear rack and pinion at interaction is directed between two surfaces of the rollers which contact the lengthwise guides of the racks. As a consequence, the gear pair consisting of a gear rack and a pinion operate reliably.

It is also expedient that the bottom of the lengthwise axial recess be convex in cross section, and that the strip be composed of two textropes fitted into said recess in such a manner that the wider bases face the bottom of the recess while the opposite side surfaces constitute a wedge-shaped recess wherein the pipe to be treated is clamped.

This embodiment of the invention permits the use of standard textropes as a flexible strip.

Owing to the fact that the wiser base of said textrope belts is facing the convex bottom of the recess, the text rope belts of the feeding mechanism are not forced out of said recess during the bending procedure.

Besides, the use of said strip allows more accurate axial alignment of the pipe with respect to the axis of the bending head, and provides for an increase in the area of clamping at feeding of the pipe into the bending head, which, in turn, permits bending of thin-walled and soft metal pipes.

A further advantage of the invention is that each hinge joint of the gear racks employs a shaft seated in semi-cylindrical grooves made in the adjacent end faces of said racks, with two washers attached to the end faces of said shaft and provided with annular bosses seated in the respective annular recesses which are made in the side surfaces of said racks.

The hinge joints of the gear racks in the chain of the present embodiment prevent fouling and subsequent failures of the racks with the result that the total service life of the chain is prolonged.

It is preferable that two axially aligned rollers are installed on both end sides of the pinion in the area where the pinion is attached, with the shafts of said rollers cantilevered to the respective cage.

This feature permits straightening the chain in the area beside the pinion, and removes the loads on the pinion and rack teeth resulting from the clamping force acting on the pipe being treated.

The invention will now be described in greater detail with reference to preferred embodiments thereof taken in conjunction with the accompanying drawings, wherein.

Figure 1:
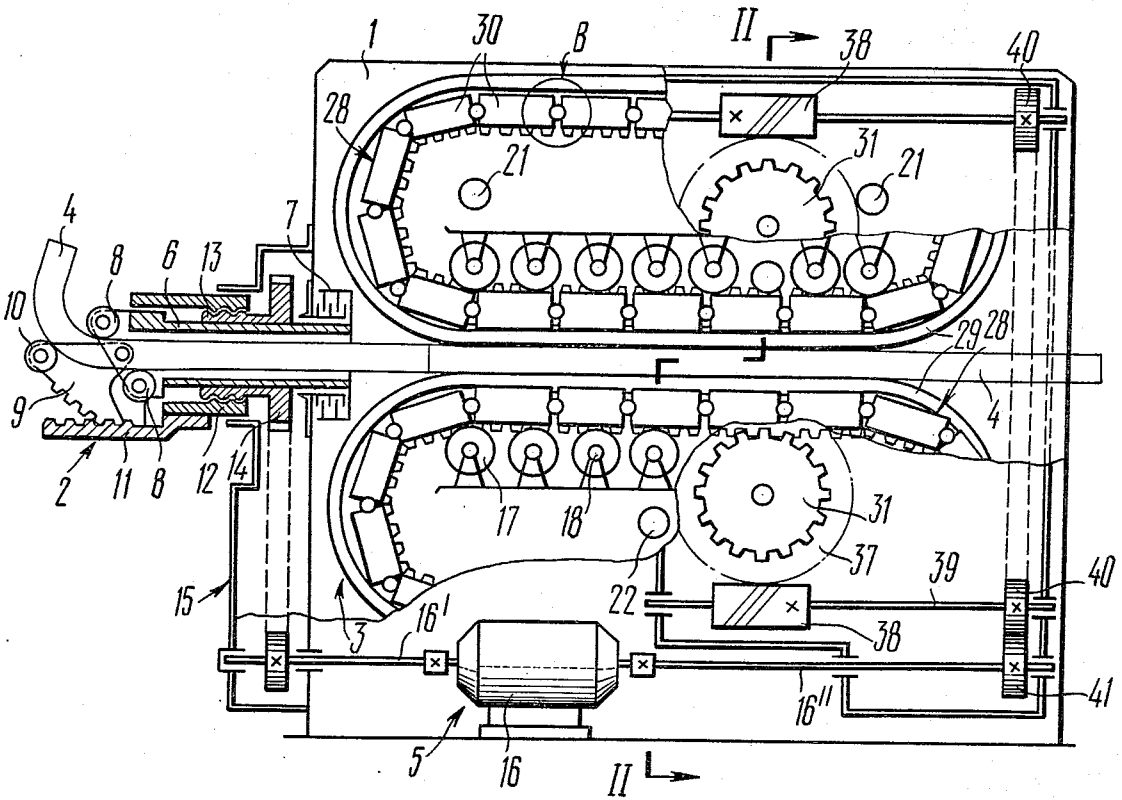
FIG. 1 shows schematically a general view of an embodiment of the pipe bending machine of the present invention (a cut-away side view, with the pipe feeding mechanism turned from the horizontal to vertical position for clarity)

Referring now to FIG. 1, the pipe bending machine comprises a bed plate 1 which mounts a bending head 2, a mechanism 3 for feeding a pipe 5 into the bending head, and a drive 5 which actuates the bending head and the feeding mechanism.

Installed on the bed plate 1 is the swivel bending head 2 of the type generally described in U.S. Pat. No. 3,373,587.

The bending head 2 comprises a hollow cylindrical body 6 cantilevered to the bed plate 1 in a horizontal position and allowed to turn about its axis. The end of the body 6 located in the bed plate 1 receives a circular brake friction clutch 7 serving to prevent inadvertent turning of the head 2 relative to the bed plate 1 with the clutch engaged.

The other free end of the body 6 of the bending head 2 carries two diametrically opposite rollers 8 between which the pipe 4 being treated is fed, with a gear segment 9 installed on the body 6 of the head 2 between said rollers, comprising two webs, with a bending roller 10 located between said webs.

The teeth of both webs of the segment 9 interact with a gear rack 11 cantilevered to nut 12 which in turn interacts with a hollow screw 13 installed on the body 6 of the head 2 and allowed to move freely.

The other end of said screw 13 (on the side of the friction clutch 7) receives a pinion 14 actuated by a reduction gear 15 of the bending head 2, with the reduction gear seated on an output shaft 16′ an an electric motor 16 which is part of a general drive 5 of the bending machine.

Figure 2:
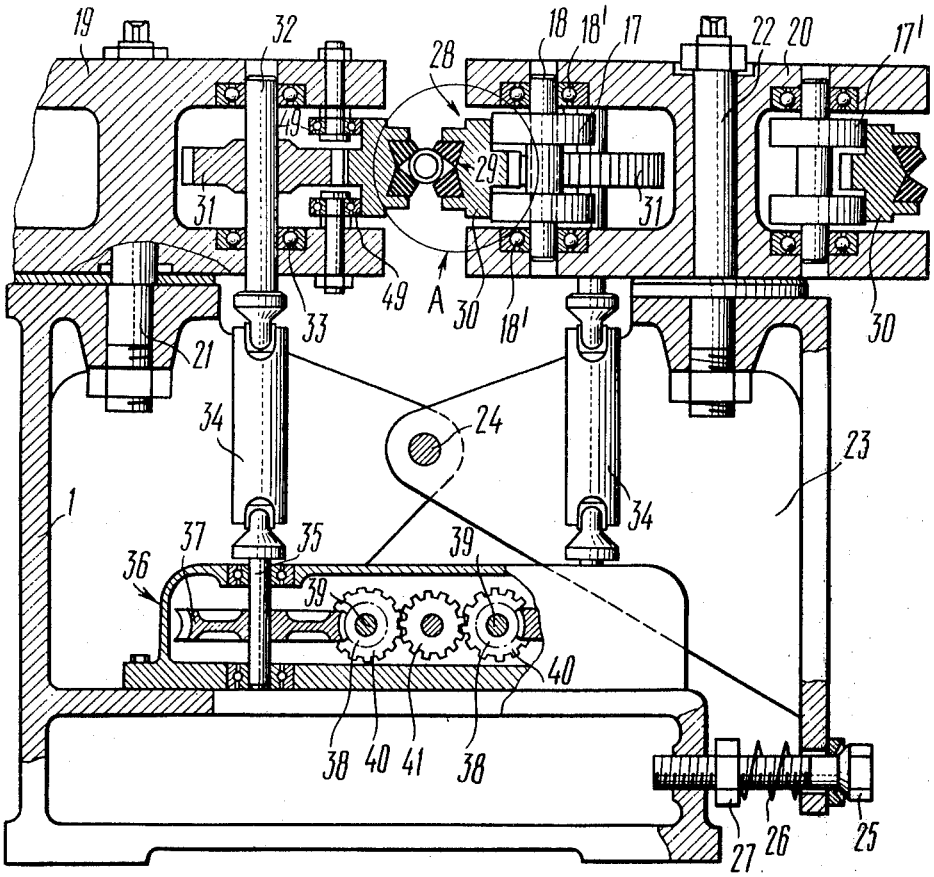
FIG. 2 is a sectional view of the pipe bending machine taken along line II—II of FIG. 1.

The mechanism 3 for feeding the treated pipe 4 into the bending head 2 incorporate two parallel rows of rollers 17 (FIGS. 1 and 2) installed in a vertical position symmetrical in relation to the axis of the pipe 4.

The rollers 17 are attached by their shafts 18 in the bearings 18′ in cages 19 and 20 (FIG. 2) used commonly by both rows of rollers. The cage 19 of one row of the rollers 17 is rigidly fixed to the bed plate 1 by means of two vertical eccentric shafts 21 serving for adjustment of the cage in position relative to the cage 20 when the mechanism 3 is to be readjusted to another diameter of the pipe 4 to be bent.

The cage 20 of the other row of rollers 17 is mounted on the bed plate 1 and is allowed to turn in the plane normal to the shafts 18 of the rollers 17 for uniform clamping of the pipe 4 throughout its length.

For this purpose, the cage 20 fitted on the vertical eccentric shaft 22 is allowed to turn freely in relation to said shaft. The eccentric shaft 22 is installed on the top arm of a vertically-set lever 23 (FIG. 2) which is hinged to the bed plate 1 by means of a horizontal shaft 24, while the hole in the other end of the lever arm receives a bolt 25 carrying a spring 26 and a nut 27 used for adjustment of the spring tension. The end of the bolt 25 is seated in the respective seat provided in the bed plate 1.

The lever 23 spring-loaded as described above provides a constant pressure on the rollers 17 in the cage 20 in the direction toward the other row of rollers 17 fitted into the cage 19, and permits moving the cage 20 off the cage 19 for placing and subsequent clamping of the first pipe 4.

According to the invention, the rollers 17 in each row in assembly with the respective cages 19 and 20 are embraced by a closed-loop hauling chain 28 (FIGS. 1 and 2), the inner side thereof is suited for coupling said drive 5 of the machine to move the chain during work toward the bending head 2.

In order that the chain 28 be moved uniformly, several thrust rollers 17′ are installed on the other side of the cage 19 or 20.

Fitted on the outer sides of both hauling chains 28, according to the invention, are closed-loop strips 29 made of elastic friction material, with the pipe 4 clamped between said strips and fed to the bending head 2 by said strips 29 when the chains 28 are displaced.

Figure 3:
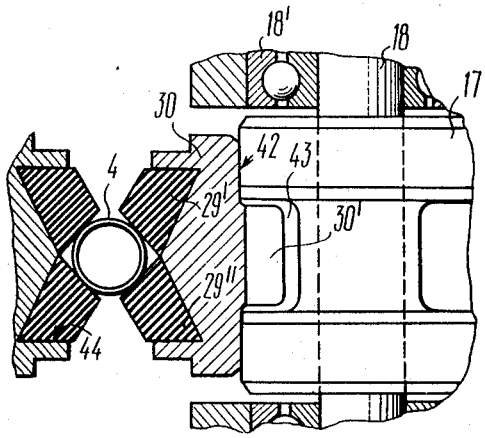
FIG. 3 is a detail A of FIG. 2 (shown to a larger scale)

Each hauling chain 28 is assembled, according to the invention, of individual gear racks 30, the teeth 30′ thereof (FIG. 3) are facing the rollers 17, with the gear racks hinged to one another.

Each chain 28 is coupled with the drive 5 by means of a driving pinion 31 (FIGS. 1 and 2), which interacts with teeth 30′ of the gear racks 30 and which is installed in the respective cage 19 or 20 essentially near the area of contact between the gear racks 30 and rollers 17 in the respective row.

Each gear rack 30 is, according to the invention, in contact with at least two rollers 17 at displacement of the hauling chain 28 so that the entire area of the chain 28 in contact with the rollers 17 is straight.

Said sections of the hauling chains 28 in motion clamp the pipe 4 between the flexible strips 29 and ensure feeding of the pipe into the bending head 2. Therefore, said sections must be straight to provide for efficient operation of the flexible strips 29 and for minimizing the wear of said strips. Besides, the gearing between the teeth 30′ of the racks 30 in each chain 28 and the pinion 31 is improved, and the service life of the teeth is prolonged. Since the pinion 31 is arranged in the initial section of the area of contact between the racks 29 in the chain 28 and the rollers 17, hazardous stretching loads acting on the hinge joints of the racks 30 are removed, and formation of gaps between the racks is precluded.

Each pinion 31 is rigidly fixed to a vertical shaft 32 arranged in bearings 33 inside the cage 19 (or 20) and is connected by its bottom end to an output shaft 35 of a worm reduction gear 36 of the drive 5 through a universal shaft 34. This type of connection of the pinions 31 to the drive 5 permits adjustment of the cages 19 and 20 in position when the bending machine is operating, for which purpose eccentric shafts 21 and 22 of said cages must be turned in the desired direction.

In order that both chains 28 be moved in step, both pinions 31 are turned simultaneously by the same worm reduction gear 36 which incorporates two output shafts 35 with worm gears 37 attached thereto and used to interact with worms 38, the shafts 39 thereof receive intermediate gears 40 which, in turn, interact with a common gear 41 seated on an output shaft 16″ of an electric motor 16 of the general machine drive 5.

Each gear rack 30 is provided, according to the invention, with lengthwise guides 42 (FIG. 3) installed on both sides of the rack teeth 30′, with the guides serving to establish contact between the rack and the rollers 17, and with annular recesses 43 provided on the roller cylindrical surfaces for passage the teeth 30′ of the racks 30.

A lengthwise axial recess 44 on the outer side of each rack 30 accommodates the strip 29.

The bottom of said recess 44 is shaped, according to the invention, as a convex chamber in cross section.

The strip 29 is assembled of two similar textrope belts 29' and 29'' seated in said recess 44 in such a manner that the wider bases of the belts face the bottom of the recess whereas the opposite side surfaces of the belts 29' and 29'' form a wedge-shaped groove wherein the pipe 4 to be bent is clamped.

Said shape of the recess 44 improves alignment of the pipe 4 relative to the axis of the bending head 2 and increases the area of the pipe 4 clamped by belts 29' and 29''.

Figure 4:
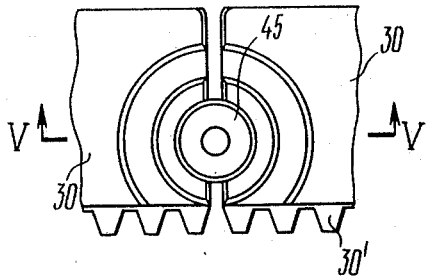
FIG. 4 is a detail B of FIG. 1 (shown to a larger scale) with the front washer removed to illustrated the hinge joint of the hauling chain gear racks)
Figure 5:
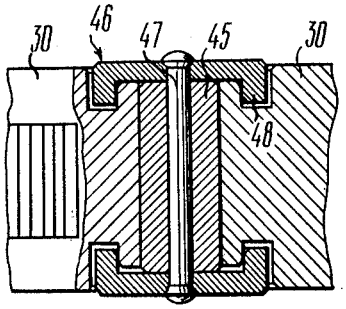
FIG. 5 is a sectional view taken along line V—V of FIG. 4.

Each hinge joint of the gear racks 30 comprises, according to the invention, a hollow shaft 45 (FIGS. 4 and 5) fitted into the respective semi-cylinder recess on the adjacent end faces of said racks 30, and two washers 46 attached to the ends of the hollow shaft 45 with a rivet 47 and provided with annular projections 48 fitted into the respective annular recesses in the side surfaces of the racks 30.

The above type of hinge joints in the racks 30 prevents the ingress of dirt and thereby prolongs the service life of the chains 28.

Installed beside the area of attachment of each pinion 31 are two axially-aligned rollers 49 (FIG. 2) located on both sides of said pinion, with the size of the rollers 49 being less than that of the rollers 17, and with the shafts cantilevered to the respective cage 19 or 20. As a result, each chain 28 is straight in the area beside the pinion 31, and the load acting on the pinion teeth and on the teeth 30' of the racks 30 due to clamping force exerted on pipe 4 is removed.

The pipe bending machine operates as follows.

Before the machine is put in operation, the cage 20 (FIG. 2) in assembly with the associated rollers 17, hauling chain 28 and strip 29 is moved off the cage 19 through turning the lever 23 about the shaft 24 which is effected by revolving the screw 25.

After a gap is formed between the belts 29' and 29'' (FIG. 3) of the strips 29, the first pipe 4 is introduced into said gap and is fed into the body 6 (FIG. 1) of the bending head 2, then the pipe is hauled between the thrust rollers 8 as far as the stop (not shown in the drawings) located in front of the bending head 2.

After the pipe 4 is introduced, the stop is pulled off.

In the first pipe 4 is shorter than the bed plate 1 of the bending machine, the next pipe 4 is placed at the end face of the first one. This operation is repeated until the rear end of the last pipe 4 projects beyond the limits of the feeding mechanism 3, whereupon the machine is ready for starting.

The pipe bending machine can be operated automatically or with the use of a manual control (not shown in the drawings).

The automatic operating cycle of the pipe bending machine begins with starting the preset program control unit which may be constructed on any known principle, as, for instance, an electromagentic friction clutch unit.

The unit follows a preset program and engages or disengages the bending roller 10 executing jigging motion, and also controls the turns of the bending head about its axis and displacement of the hauling chains 28 of the mechanism 3 serving to feed the pipe 4 into the bending head 2.

On energizing of the electric motor of the drive 5 common for the bending head 2 and feeding mechanism 3, the rotary motion is transmitted from one of the output shafts 16' (FIG. 1) of the electric motor 16 to the reduction gear 15 of the bending head 2.

The motion is further on translated to the gear 14, and is transmitted therefrom to the hollow screw 13 (provided that the brake clutch 7 holding the body 6 of the bending head 2 in stationary state is activated), so that the hollow screw displaces the nut 12 in an axial direction. To prevent a turn of said nut 12 relative to the screw 13, use is made of the gear rack 11 rigidly fixed to the nut and installed on the guides of the body 6 of the head 2.

Consequently, the nut 12 together with the gear rack 11 reciprocates along the axis of the body 6 of the head 2 at reversing rotation of the hollow screw 13.

The gear segment 9 interacting with the rack 11 is set to jigging motion which causes the bending roller 10 to come into contact with the pipe hauled by the feeding mechanism 3 between the thrust rollers 8 of the head 2. The pipe is bent in a direction preset by the program.

The bending radius of the pipe 4 depends on the amount of travel of the roller 10, and the bending angle depends on the time during which the roller 10 is held stationary in the position preset by the program.

After the preset bending radius is obtained, the bending roller 10 stops, and starts retracting to the initial position after the desired bending angle is produced.

The motion of the bending roller 10 and, hence, of all the moving parts of the head 2 is reversed by switching-over the electromagnetic friction clutches (not shown in the drawings) which are arranged in the housing of the reduction gear 15 of the bending head 2.

At the instant when the bending roller 10 is separated from the pipe 4, bending is interrupted, and, if feeding is continued, the pipe 4 moves out of the body 6 of the head 2 without bending, i.e., a straight portion is formed. The pipe remains straight till the bending roller 10 (already returned to the initial position) starts its movement toward the pipe 4 for shaping a subsequent bend in response to the program.

If the adjacent bends of the pipe 4 are located in different planes, the bending head 2 is turned about its axis through a predetermined angle between two planes of the adjacent bends of the pipe 4 when the latter is moving free through the body 6 of the head 2.

For turning the head 2, the brake clutch 7 serving to prevent inadvertent turning of the body 6 of the head 2 at bending of the pipe 4 is activated.

In this case, the end face of the nut 12 thrusts against the end face of the gear 14 which moves further and engages the body 6 caused to turn together with said gear 14 and with other parts of the head 2 through a predetermined angle between two planes of the adjacent bends of the pipe 4.

When a desired angle is reached by the head 2, the brake clutch 7 is engaged, and the head 2 is fixed in the preset position relative to the bed plate 1 of the machine.

The operating cycle is completed after the last bend is made, and the bending roller 10 returns to the initial position while the ready pipe is forced out by the next pipe 4 which thrusts against the tail of the preceding pipe, with the forward end of said next pipe 4 reaching the stop extended in front of the head 2.

If the control unit of the machine is immobilized, the above operating cycle is repeated. In case of continuous repeating of the operating cycles, the pipes 4 to be bent are fed with the forward end pressed directly against the tail end of the preceding pipe 4 drawn at feeding into the bending head 2. This type of feed of the pipes 4 can be effected either manually or through the use of a feeding device (not shown in the drawings).

Feeding mechanism 3 serving to feed the pipe 4 into the bending head 2 operates as follows.

After the electric motor 16 is started, the motion is translated from the other output shaft 16'' of the motor (FIG. 1) to the gear 41 in the reduction gear 36 (FIG. 2) and is further on transmitted through the gear 40, worms 38 and worm gears 37 to the universal shafts 34 and pinions 31.

As the teeth of said pinions 31 interact with the teeth 30' of the racks 30 in the hauling chains 28 (FIG. 1), the chains together with the strips 29 and the pipe 4 clamped between the belts 29' and 29'' (FIG. 3) of said strips are moved by the guides 42 of the racks 30 over the rollers 17 toward the bending head 2 and are caused to feed the pipe 4 into the body 6 of the bending head 2.

Since the areas of contact between the chains 28, the rollers 17 and the strips 29, as well as between the strips 29 and the pipe 4 being treated are straight, no slippage occurs between the pipe surface and the strips 29, and the pipe 4 is fed into the bending head 2 at a constant rate preset by the drive 5. Owing to this, the pipes 4 can be bent at a higher accuracy, and the bending machine can be used for bending complicated three-dimensional parts at a higher rate, so that said bending machines become universal. In addition, the bending machines of the present invention permit bending thin-walled, soft metal and polished-surface pipes.

We claim:

1. A pipe bending machine comprising a bed plate; a bending head mounted on said bed plate; a mechanism for feeding pipes to be treated into said bending head, with said mechanism installed on said bed plate; a drive serving to actuate said bending head and said feeding mechanism, with said drive installed on said bed plate; two parallel rows of rollers of said feeding mechanism arranged symmetrically relative to the axis of the pipe being treated; two cages, each incorporating one of said rows of rollers, with the first said cage rigidly fixed to said bed plate and with the second said cage installed on said bed plate, allowed to turn in the plane normal to the axis of said rollers and spring-loaded in the direction toward said first cage; two closed-loop hauling chains, each embracing the rollers of one of said rows in assembly with said cage, with each said hauling chain provided on the inner side for coupling with said drive used to displace said chain toward said bending head; and two closedloop strips made of elastic friction material, each strip being formed of two belts which cooperate to clamp the pipe, each strip being provided on the outside of one of said hauling chains, and with the pipe clamped in the gap between said chains which feed said pipe into the bending head when said chains are displaced.

2. A pipe bending machine as claim in claim 1, wherein each hauling chain is assembled of individual gear racks, the teeth thereof are facing the rollers, with said racks hinged to one another, and with each chain coupled with the drive by means of a pinion which interacts with the teeth of said racks and is installed on the cage of the respective row of rollers essentially beside the initial portion of the area of contact between said rollers and said cages of the chain.

3. A pipe bending machine machine as claimed in claim 2, wherein each gear rack contacts simultaneously at least two rollers when the chain is displaced.

4. A pipe bending machine as claimed in claim 2, wherein each gear rack is provided with lengthwise guides on both sides of the rack teeth, with the lengthwise guides serving to establish contact between said rack and the rollers, the cylindrical surfaces thereof are provided with annular recesses for passage of the rack teeth, with a lengthwise axial recess on the outer side of each rack used to accommodate the strip.

5. A pipe bending machine as claimed in claim 4, wherein the bottom of the lengthwise axial recess is shaped as a convex chamber in cross section, and wherein each strip is assembled of two text-rope belts arranged in a respective recess in such a manner that the wider bases of the belts face the bottom of the recess whereas the opposite side surface form a wedge-shaped recess whereat the pipe to be treated is clamped.

6. A pipe bending machine as claimed in claim 2, wherein each hinge joint of the gear racks includes a hollow shaft fitted into the respective semi-cylindrical recesses made in the adjacent end faces of said racks, and two washers attached to the end faces of said shaft, with the annular projections on said washers seated into the respective annular recesses in the side surfaces of said racks.

7. A pipe bending machine as claimed in claim 2, wherein two axially aligned rollers are installed beside the area of attachment of each pinion on both end sides, with the shafts of said rollers cantilevered to the respective cages.

8. A pipe bending machine as defined in claim 1, wherein said two strips are arranged in spaced opposition to each other, and the opposing facing side surfaces of said belts of said strips form wedge-shaped grooves which are adapted to at least partially receive the peripheral surface of the pipe, whereby the contact stresses on the pipe are more uniformly applied thereto to permit bending of thin-walled, soft metal or polished-surface pipes having different diameters with minimum deformation of the pipe surfaces.

* * * * *